US006424698B1

(12) United States Patent
Weekamp et al.

(10) Patent No.: US 6,424,698 B1
(45) Date of Patent: Jul. 23, 2002

(54) FILTER AND X-RAY EXAMINATION APPARATUS

(75) Inventors: Johannus Wilhelmus Weekamp; Adrianus Cornelius Van Kasteren; Jacobus Bernardus Giesbers; Bartholomeus Petrus Hendricus Van Nunen; Menno Willem Jose Prins, all of Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/678,967

(22) Filed: Oct. 4, 2000

(30) Foreign Application Priority Data

Oct. 4, 1999 (EP) ..... 99203240

(51) Int. Cl.[7] ..... G21K 3/00
(52) U.S. Cl. ..... 378/156; 378/158
(58) Field of Search ..... 378/156, 158, 378/159

(56) References Cited

U.S. PATENT DOCUMENTS 6,181,774 B1 * 1/2001 Prins et al. ..... 378/159

* cited by examiner

*Primary Examiner*—Robert H. Kim
*Assistant Examiner*—Jurie Yon
(74) *Attorney, Agent, or Firm*—John Vodopia

(57) ABSTRACT

A filter which includes a stack of deformable foils which are locally attached to one another, and also includes comparatively rigid members which are situated to both sides of the stack of foils, extend parallel to the surface of the foils and each of which is attached to an outer surface of the stack of foils by way of a buffer member. The foils can be moved away from one another in a main direction by means of the rigid members, which main direction extends transversely of the surface, in order to form ducts between the foils. The buffer member is then contractible mainly in a direction which extends parallel to the surface and transversely of the ducts.

9 Claims, 7 Drawing Sheets

FILTER AND X-RAY EXAMINATION APPARATUS

BACKGROUND OF THE INVENTION

The invention relates to a filter which includes a stack of foils which are locally attached to one another the rigid member enabling the foils to be moved away from one another in a main direction which extends transversely of the surface, ducts being formed between the foils and also includes comparatively rigid members which are situated to both sides of the stack of foils, extend parallel to the surface of the foils and at least one of which is attached to an outer surface of the stack of foils by way of a buffer member.

SUMMARY OF THE INVENTION

The invention also relates to an X-ray examination apparatus provided with such a filter.

In the context of the present patent application a filter is to be understood to mean any system of ducts comprising a number of ducts.

A filter and an X-ray examination apparatus of this kind are described in the not previously published European patent application 98201706.3 (PHN 16.919) in the name of applicant.

In order to form the ducts or channels between the foils the interconnected oils are deformable and are moved apart in a main direction which extends transversely of the surfaces of the foils in the stack, notably of the outer surfaces. The distance between the outer surfaces of the stack of foils then increases; the dimension of the foils in a duct direction which extends parallel to the ducts to be formed remains the same whereas the foils assume undulating patterns in a transverse direction which extends transversely of the duct direction and the main direction and parallel to the surface, the dimension of the stack of foils in said transverse direction being reduced due to said undulating patterns.

The rigid members are only moved away from one another and are not subject to deformation. The buffer member serves to create a smooth transition between the rigid members and the outer surfaces of changing dimensions, so that the foils situated near the outer surfaces of the stack of foils can assume the same undulating pattern as the foils situated near the center of the stack. As a result, all ducts situated between the foils will have the same shape.

In the cited European patent application the buffer member is made of a rubber, a viscoelastic material or an elastic material.

Materials of this kind, however, have the drawback that a tensile force applied thereto in the main direction and a desired shrinkage in the transverse direction are accompanied by shrinkage in the duct direction. Such a deformation in the duct direction, however, is undesirable, because the foil connected to the buffer member will then also be subject to such a deformation, so that the ducts situated opposite the foil will have a shape other than that of the other ducts of the filter.

It is an object of the invention to provide a filter in which such shrinkage in the duct direction is prevented.

This object is achieved in the filter according to the invention in that the buffer member is contractible mainly in a direction extending parallel to the surface and transversely of the ducts.

The buffer member according to the invention incurs no or only negligibly small deformation in the duct direction and is deformed only in the transverse direction. Various embodiments of buffer members having such deformation properties are disclosed in the dependent claims.

The buffer member in an embodiment of the filter according to the invention includes a number of laminations, each of which is rigidly connected, near a first edge, to a plate which constitutes the rigid member, each lamination being connected to one of the outer surfaces of the stack of foils by way of a second edge which is remote from the first edge, the second edges extending parallel to the ducts and being movable towards one another while the foils move away from one another in the main direction.

The second edges of the laminations, for example made of paper or foil, can simply move relative to one another in the transverse direction, without the laminations being subject to deformation in the duct direction.

The buffer member in a further embodiment of the filter according to the invention is provided with a spring comprising turns, the rigid member extending through the turns and the turns being connected to one of the outer surfaces of the stack at a side which is remote from the rigid member.

The turns of the springs can be moved towards and away from one another in the transverse direction. The dimension of the turns does not change, or only hardly so, in the duct direction.

The filter according to the invention is suitable for use in an X-ray examination apparatus which includes an X-ray source and an X-ray detector, the filter being situated between the X-ray source and the X-ray detector. An X-ray absorbing liquid is introduced into the ducts of the filter, the X-ray absorptivity of each duct being adjustable by adjustment of the amount of X-ray absorbing liquid in the individual ducts.

BRIEF DESCRIPTION OF THE DRAWINGS

The invention will be described in detail hereinafter with reference to the drawing; therein

Corresponding components in the Figures are denoted by corresponding reference numerals.

DESCRIPTION OF THE PREFERRED EMBODIMENTS

Figure 1:
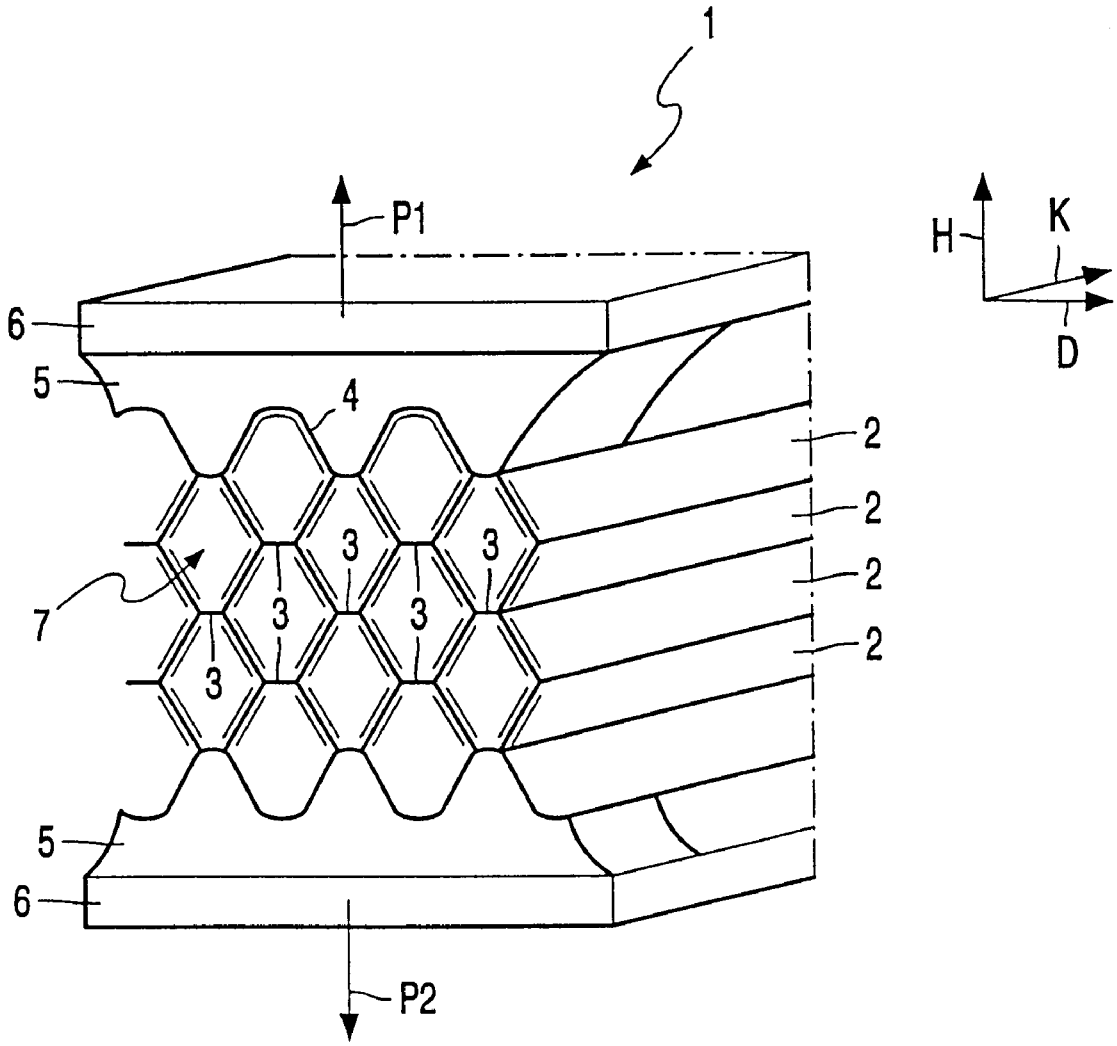
FIG. 1 shows a filter in conformity with the not previously published European patent application 98201706.3.

FIG. 1 shows a filter 1 as disclosed in the not previously published European patent application 98201706.3. The filter 1 includes a number of synthetic foils 2, four of which are shown in FIG. 1. In the case of a filter 1 for an X-ray examination apparatus, for example, more than one hundred foils are connected to one another. The synthetic foils 2 are locally attached to one another along seams 3. The outer foils 2 of the stack of foils are attached to buffer members 5 by means of an adhesive layer 4. The buffer members are connected to rigid metal plates 6 at a side which is remote from the foils. The plates 6 can be moved away from one another in a main direction H which is denoted by arrows P1, P2. Due to the displacement of the plates 6, relative to one another, the foils 2 are moved apart via the buffer members 5 and the adhesive layers 4. Thus, ducts 7 which extend parallel to the seams 3 in a duct direction K are formed between the foils 2 and the seams 3. The degree of displacement of the plates 6, the dimensions of the seams 3 and the spacing of these seams determine the cross-section of the ducts 7. During the moving apart of the plates 6 the foils 2 assume an undulating pattern. Consequently, the dimension of each foil decreases in a transverse direction D which extends transversely of the main direction H and the duct direction K. In order to ensure that the foils which are connected to the buffer members 5 assume an undulating pattern similar to that of the foils situated near the center, the buffer members 5 should also undergo such a change in the transverse direction D at a side facing the foils. At a side which is remote from the foils 2, however, the buffer member 5 is connected to the rigid plate 6 which is not subject to a change of dimensions.

The buffer member 5 in the filter 1 in conformity with the cited European patent application comprises a rubber, a viscoelastic material or an elastomer material. In the case of deformation in the transverse direction D this material will also be subject to a deformation in the duct direction K; as has already been stated, the latter deformation is undesirable.

Figure 2A:
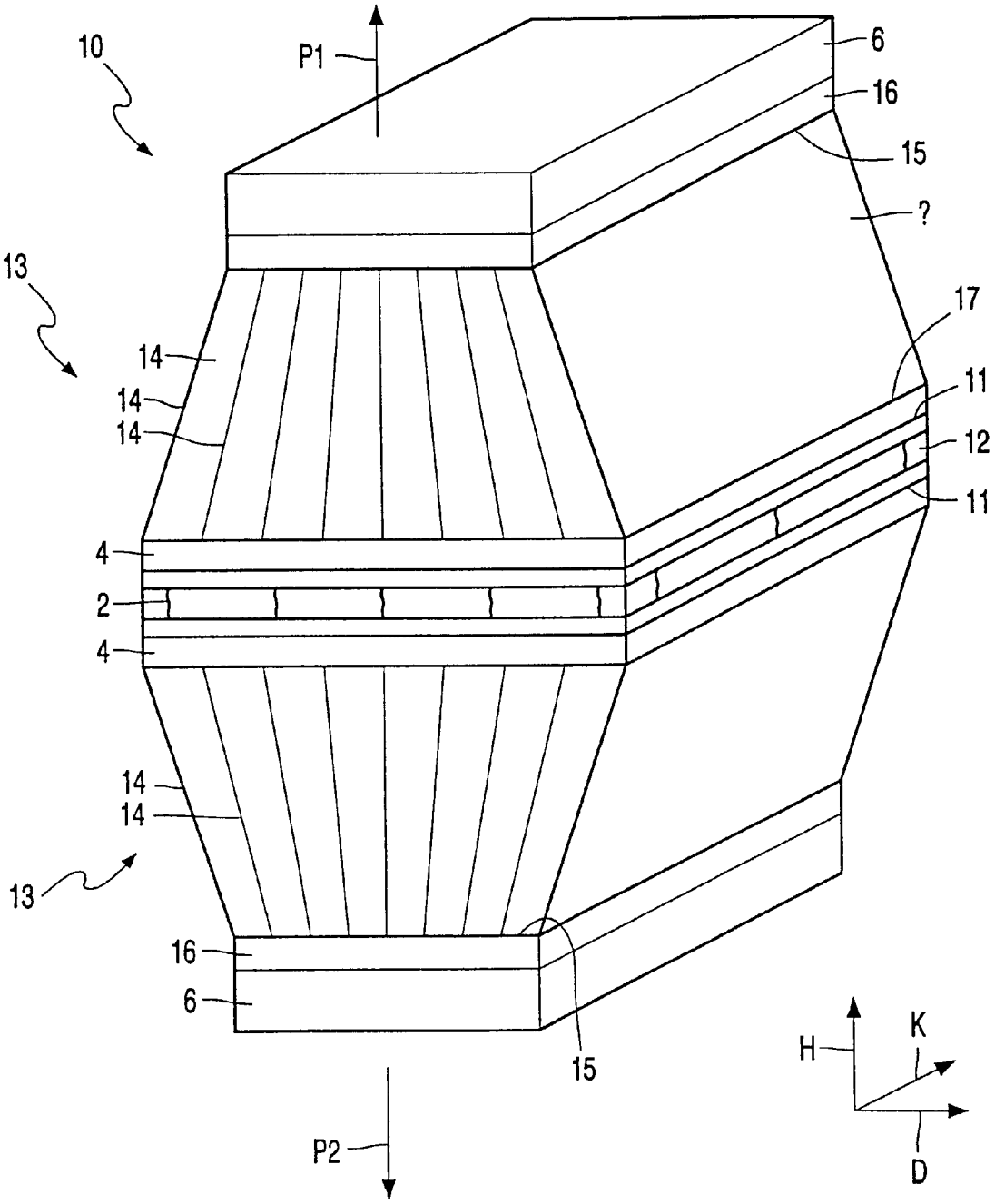
FIGS. 2A and 2B show a filter according to the invention with foils situated against one another and with foils moved apart from one another, respectively.
Figure 2B:
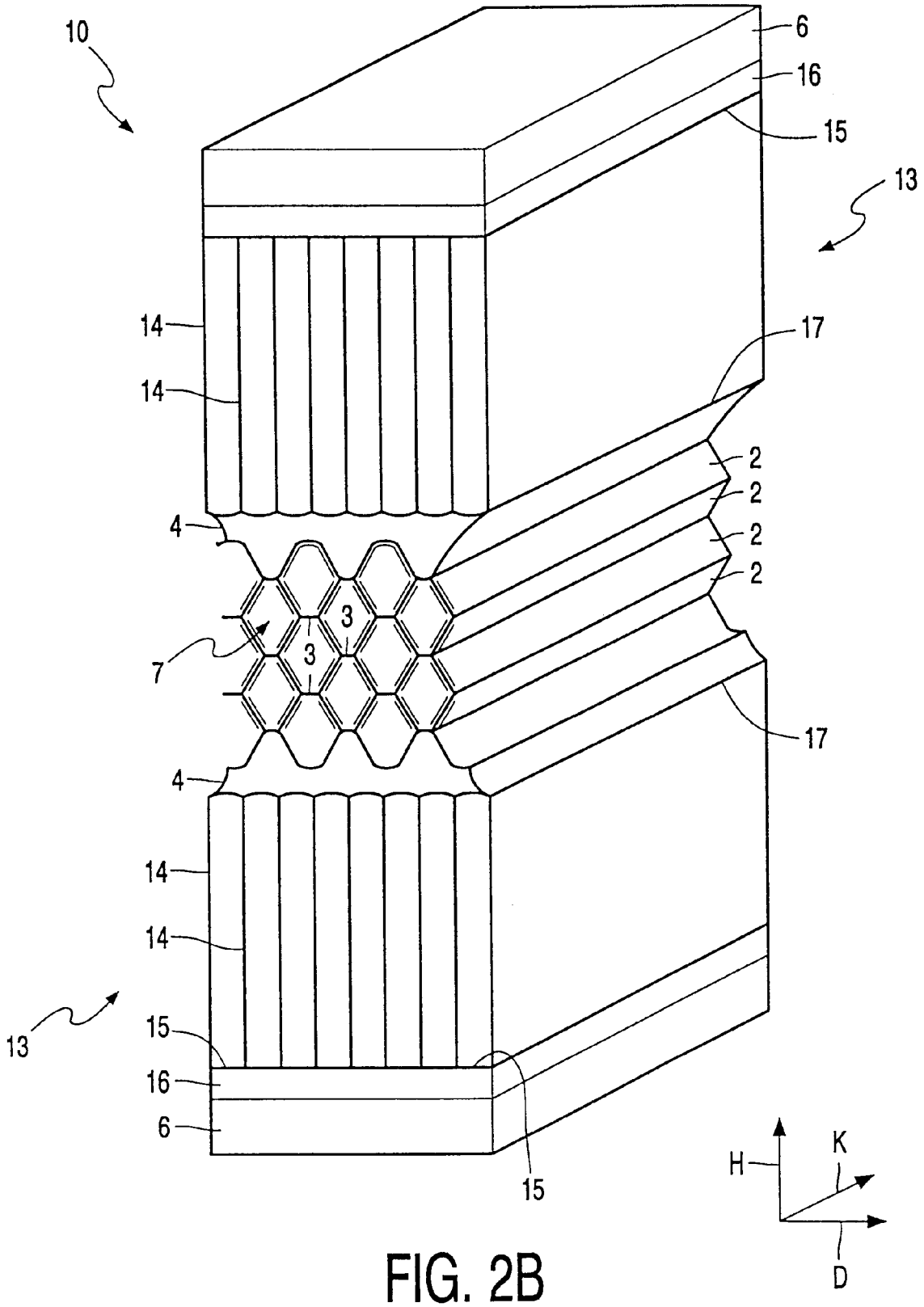

FIGS. 2A and 2B show a filter 10 according to the invention with foils 2 which are arranged against one another and foils 2 which have been moved away from one another, respectively. The filter 10 includes a number of foils 2 which are attached to one another along seams 3 and a two-side adhesive layer 4 which is connected to the outer surfaces 11 of the stack of foils 12. The filter 10 also includes buffer members 13, each of which includes a comparatively large number of laminations 14. A first edge 15 of each lamination 14 is connected, by way of a two-side adhesive layer 16, to a plate 6 which extends parallel to the foils 2. A second edge 17 which is remote from the first edge 15 of each lamination 14 is connected to a side of the adhesive layer 4 which is remote from the stack of foils 12. The first edge 15 and the second edge 17 extend parallel to a duct direction K.

As is clearly shown in FIG. 2A, near the first edge 15 the laminations 14 are situated nearer to one another than near the second edge 17. Such a fan-like arrangement of the laminations 14 can be realized, for example by first connecting the first edges 15 of the laminations 14 to the adhesive layer 16. Subsequently, the adhesive layer 16 is bent around a tube so that the laminations 14 extend radially from the tube, after which the adhesive layer 4 is applied to the free second edges 17. After the adhesive layers 4 and 16 have thus been provided on the buffer member 13, the adhesive layers 4 and 16 are connected to the stack of foils 12 and to the plate 6, respectively.

In order to bring the filter 10 from the collapsed position shown in FIG. 2A, in which the foils 2 are arranged against one another, into the unfolded position shown in FIG. 2B, the plates 6 are moved away from one another in directions which are denoted by arrows P1, P2 and extend parallel to the main direction H. The foils 2 then assume the undulating patterns which are also assumed by the adhesive layers 4. The adhesive layers 4 are then deformed in the transverse direction D, so that the second edges 17, attached to the adhesive layers 4, are moved towards one another. The laminations 14 are not subject to deformation in the duct direction K during such a displacement of the second edges 17 of the laminations 14. The adhesive layer 4 in the filter shown in the FIGS. 2A and 2B has a comparatively large thickness and serves as a transitional zone between the foils 2 and the buffer member 13. Because of the elastic and deformable adhesive layer 4, the outer foils will always assume the same undulating pattern as the foils situated near the center.

However, it is alternatively possible to make the adhesive layer 4 comparatively thin; the outer foils then follow substantially the same contour as the second edges 17 of the laminations 14 and all foils assume a similar undulating pattern as from a small distance from the edges 17 only.

In both cases the laminations 14, and hence also the foils 2, are not subject to deformations in the duct direction K.

As is shown in FIG. 2B, in the desired ultimate position of the foils 2 the laminations 14 extend parallel to one another, so that all forces exerted on the foils are directed in the main direction H.

FIGS. 3A–3D show a second embodiment of a filter 20 according to the invention, the assembly of the filter 20 being shown in steps from FIG. 3A to FIG. 3D.

Figure 3A:
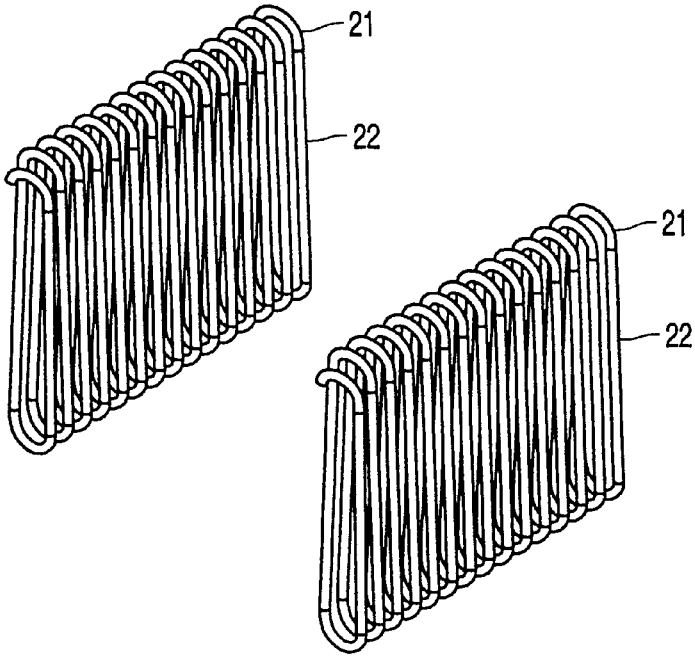
FIGS. 3A–3D are various perspective views of a second embodiment of a filter according to the invention in which the assembly of the filter is diagrammatically represented in a number of steps.
Figure 3B:
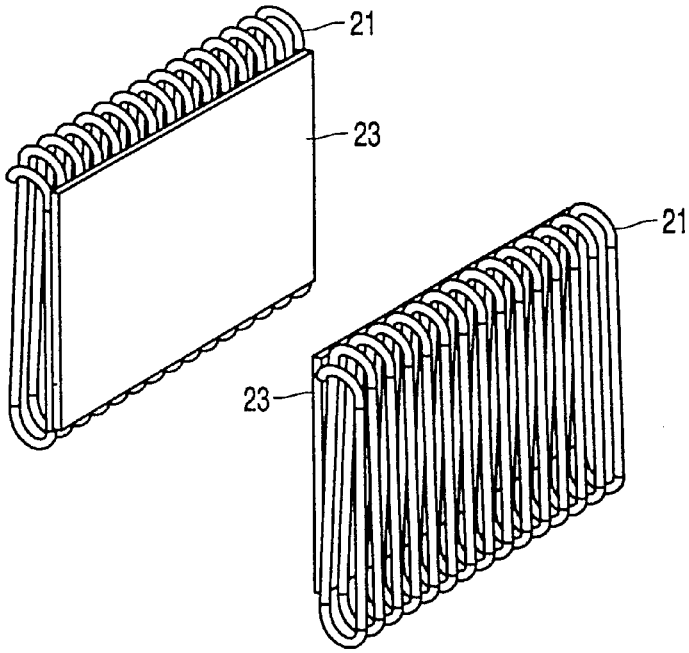
Figure 3C:
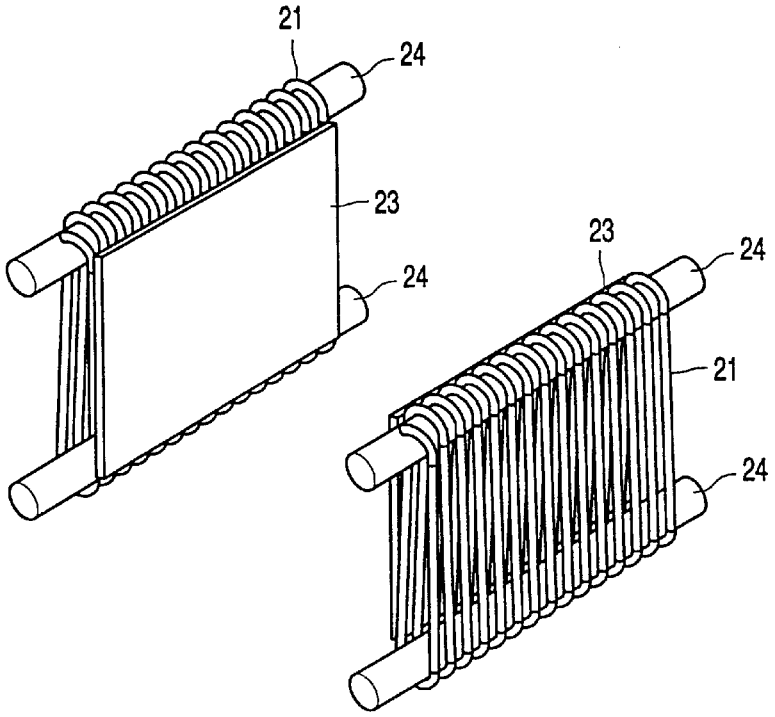
Figure 3D:
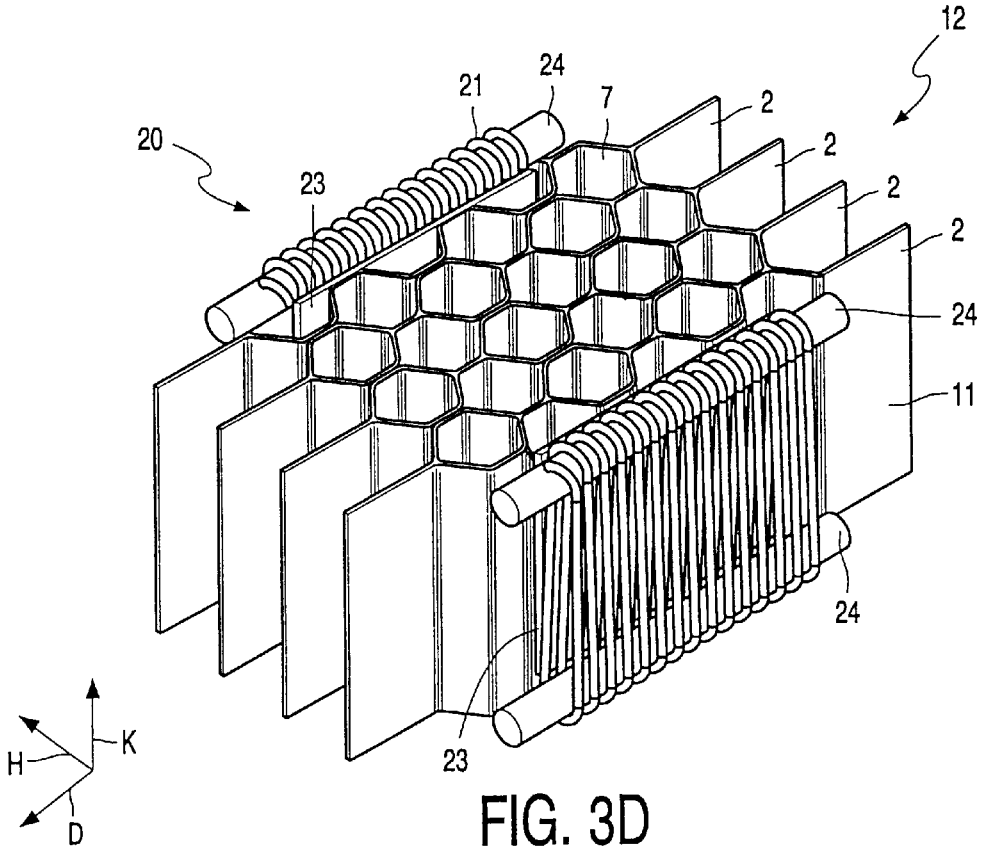

FIG. 3A shows two coiled springs 21, each of which comprises a number of adjacent, substantially rectangular turns 22. Two-side adhesive layers 23 are provided on facing outer sides of the springs 21 (see FIG. 3B). Subsequently, two parallel extending metal rods 24 are inserted through the turns 22 of each spring 21 (see FIG. 3C). Subsequently, an outer surface 11 of a stack of foils 12 is connected to each two-side adhesive layer 23. When the metal rods 24 of the individual springs 21 are moved away from one another in a direction parallel to the main direction, the foils are pulled apart and the ducts 7 are formed therebetween (see FIG. 3D). During the deformation the foils will contract in the transverse direction D; this contraction is also performed, via the adhesive layers 23, by the turns 22 of the springs 21 which move towards one another.

It is also possible, of course, to insert a rectangular plate through the turns 22 instead of two rods 24.

Of course, it is also possible to provide, instead of a spring with turns, a number of rectangular rings which extend across the rods 24 and are displaceable relative to one another in the transverse direction D.

Figure 4A:
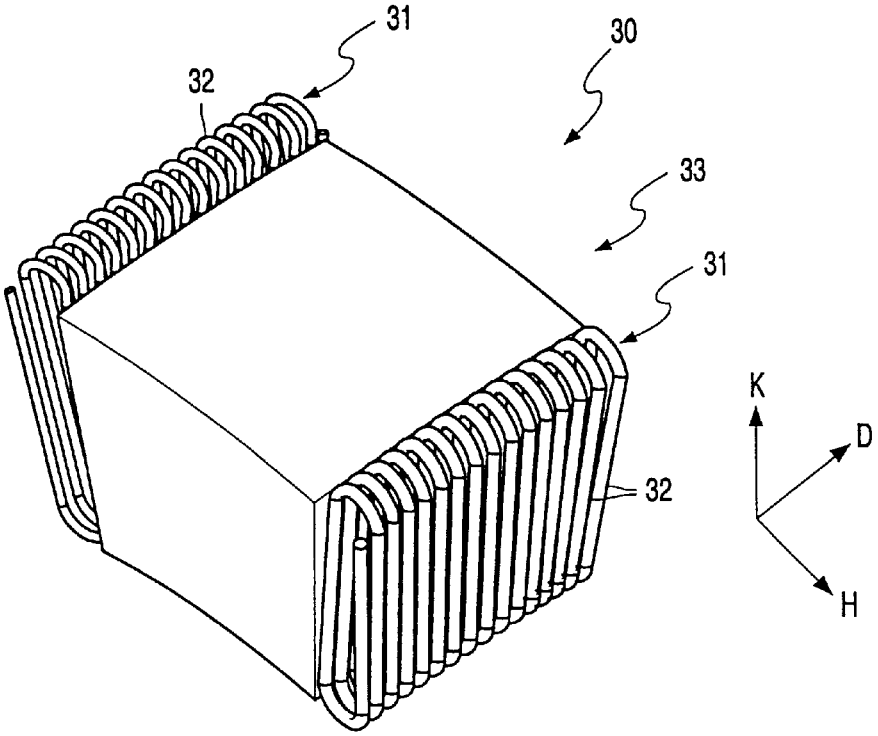
FIGS. 4A-4C are a perspective view, a side elevation and a front view of a third embodiment of a filter according to the invention.
Figure 4B:
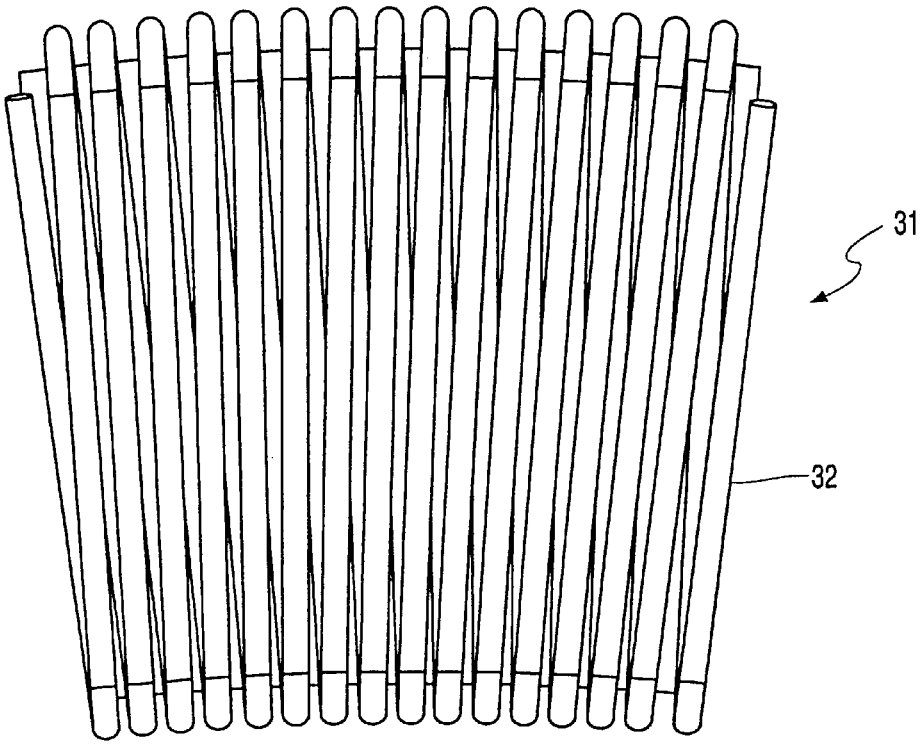
Figure 4C:
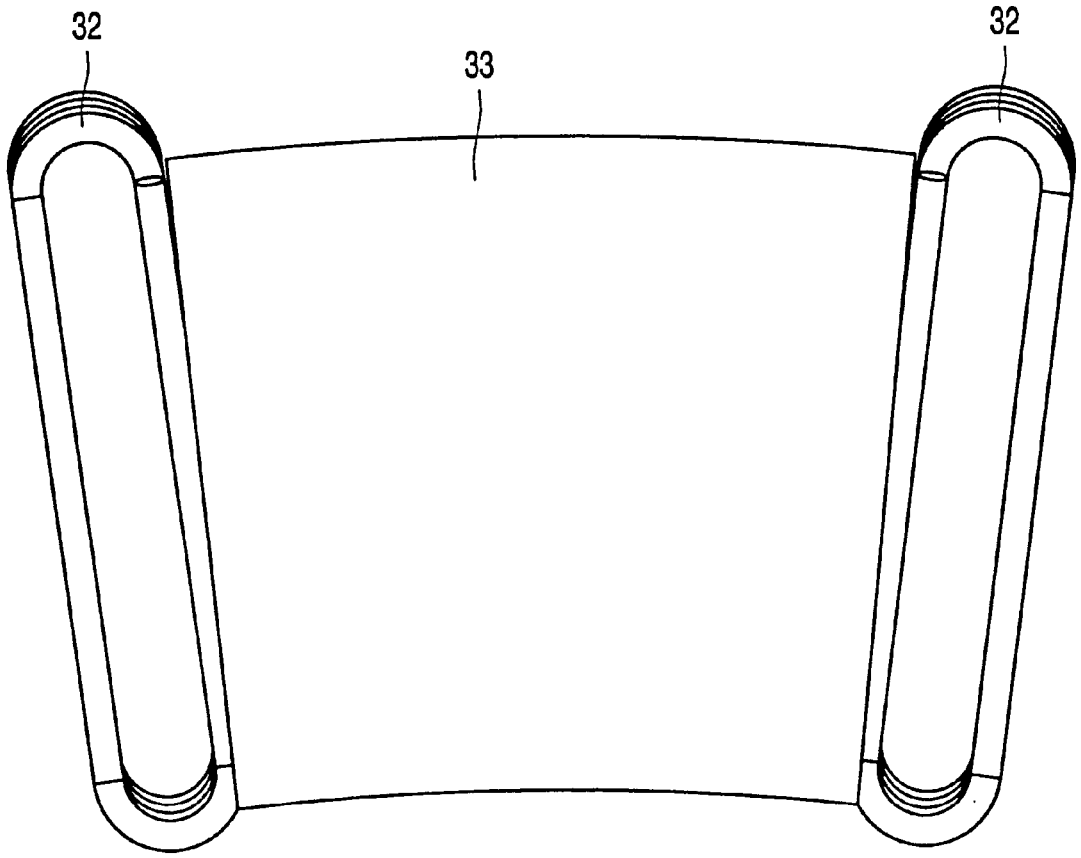

The FIGS. 4A–4C show a third embodiment of a filter 30 according to the invention which is provided with two coiled springs 31, each of which comprises a number of adjacent, substantially rectangular turns 32. As is clearly visible in the side elevation of FIG. 4B and the front view of FIG. 4C, the turns 32 of a spring 31 are arranged relative to one another in such a manner that near a lower side they are situated nearer to one another in comparison with the upper side (see FIG. 4B). Moreover, the turns of the oppositely situated springs 31 are situated nearer to one another at the lower side in comparison with the upper side (see FIG. 4C). The filter 30 is also provided with a stack of foils 33 whose seams 3 are situated relative to one another in the same way as the turns 32 of the spring 31. The turns 32 of the springs 31 are attached to the stack of foils 33 in the same way as the stack of foils of the filter 20 shown in FIG. 3D.

Rigid members (not shown) are inserted through the turns 32 of the springs 31, after which the rigid members are moved away from one another while tilting the rigid members relative to one another at the same time, with the result that the rigid members are given the same orientation as the turns 32 of the individual springs 31 (see FIG. 4C). Consequently, the ducts formed in the filter 33 extend at different angles relative to one another.

The foils are spaced less far apart near the lower side in comparison with the spacing at the upper side. As a result, the contraction occurring in the transverse direction at the lower side will be less than that occurring at the upper side. As a result of the arrangement of the turns 32 as shown in FIG. 4B, the displacement of the turns relative to one another can also be smaller near the lower side than that near the upper side.

The two-side adhesive layer may be, for example a VHB two-side adhesive layer manufactured by 3M. The adhesive layer of an elastic material ensures that even the outer foils have the same undulating pattern as the foils 2 situated near the center.

A coating of, for example parylene of a thickness of 10 $\mu$m can be deposited in the ducts 7 after the foils 2 have been moved apart. It is also possible to provide a layer of epoxy glue in the ducts 7. Application of such agents reinforces the honeycomb structure formed and also enables the removal of the buffer members and the rigid members.

The filters 10 and 20 according to the invention are suitable for use in inter alia X-ray examination apparatus in which a desired quantity of X-ray absorbing liquid is introduced into the ducts 7. To this end, the walls of the ducts 7 may be coated with an electrically conductive metal for application of a potential voltage to the walls, thus enabling control of the desired liquid level in each duct 7.

The filter may also be used, for example, as a gas filter, a light distributor, etc.

The turns of the springs may also have a D-shaped cross-section, their flat side then facing the filter.

What is claimed is:

1. A filter which includes a stack of foils which are locally attached to one another including a pair of oppositely and substantially parallel disposed rigid members, forming top and bottom filter surfaces, between which pair of rigid members a stack of foils are disposed, wherein movement of the rigid members away from each other enables the foils to be moved away from one another in a rain direction which extends transversely to the surfaces, ducts being formed between the foils including walls coated with electrically conductive material in order to control an amount of x-ray absorbing liquid to be contained within the ducts, wherein at least one of the rigid members is attached to an outer surface of the stack of toils by way of a buffer member, wherein the buffer member is contractible mainly in a direction extending parallel to the surface of the foils and transversely to the ducts, and wherein the buffer member includes a number of laminations, each of which is rigidly connected, near a first edge, to a plate which constitutes the rigid member, each lamination being connected to one of the outer surfaces of the stack of foils by way of a second edge which is remote from the first edge, the second edge extending parallel to the ducts and being movable towards the first edge while the foils move away from one another in the main direction.

2. A filter as claimed in claim 1, wherein the laminations extend parallel to one another after the foils have moved away from one another over a given distance.

3. A filter as claimed in claim 1, wherein the buffer member is connected to one of the outer surfaces of the stack of foils by means of an elastic means.

4. A filter as claimed in claim 3, wherein the elastic material is a two-side adhesive layer.

5. An X-ray apparatus which includes a control device, an X-ray source, an X-ray detector, a filter as set forth in claim 1 which is arranged between the X-ray source and the X-ray detector and includes ducts and an X-ray absorbing liquid which is contained in the ducts, the quantity of X-ray absorbing liquid variable in the individual ducts to vary the X-ray absorptivity of the ducts, which quantity and consequential absorptivity being adjustable by means of the control device.

6. A filter which includes a stack of foils which are locally attached to one another including a pair of oppositely and substantially parallel disposed rigid members, forming top and bottom filter surfaces, between which pair of rigid members a stack of foils are disposed, wherein movement of the rigid members away from each other enables the foils to be moved away from one another in a main direction which extends transversely to the surfaces, ducts being formed between the foils including walls coated with electrically conductive material in order to control an amount of x-ray absorbing liquid to be contained within the ducts, wherein at least one of the rigid members is attached to an outer surface of the stack of foils by way of a buffer member, wherein the buffer member is contractible mainly in a direction extending parallel to the surface of the foils and transversely to the ducts, and wherein the buffer member is provided with a spring which includes turns, the rigid member extending through the turns and the turns being connected to one of the outer surfaces of the stack at a side which is remote from the rigid member.

7. A filter as claimed in claim 6, wherein the rigid member includes two rods extending parallel to one another.

8. A filter as claimed in claim 1, wherein the rods are made of metal.

9. An X-ray apparatus which includes a control device, an X-ray source, an X-ray detector, a filter as set forth in claim 6 which is arranged between the X-ray source and the X-ray detector and includes ducts and an X-ray absorbing liquid which is contained in the ducts, the quantity of X-ray absorbing liquid variable in the individual ducts to vary the X-ray absorptivity of the ducts, which quantity and consequential absorptivity being adjustable by means of the control device.

* * * * *